United States Patent [19]

Berg et al.

[11] Patent Number: 4,948,007

[45] Date of Patent: Aug. 14, 1990

[54] UNDERGROUND STORAGE TANK OF CORROSION-RESISTANT MATERIALS WITH INTERNAL STEEL RIB

[75] Inventors: Robin Berg, Hudson, Wis.; John Burwell, Eagan, Minn.

[73] Assignee: Xerxes Corporation, Minneapolis, Minn.

[21] Appl. No.: 370,038

[22] Filed: Jun. 22, 1989

[51] Int. Cl.[5] ..... B65D 6/34; B65D 8/08

[52] U.S. Cl. ..... 220/5 A; 220/71; 220/425; 220/444; 220/901

[58] Field of Search ..... 220/71, 72.1, 5 A, 444, 220/901

[56] References Cited

U.S. PATENT DOCUMENTS

| | | | |
|---|---|---|---|
| 2,818,191 | 12/1957 | Arne | 220/71 |
| 2,940,734 | 6/1960 | Harvey | 220/71 |
| 3,246,394 | 4/1966 | Meyer | 220/71 |
| 3,246,788 | 4/1966 | Meyer | 220/71 |
| 3,335,903 | 8/1967 | Anderson | 220/71 |
| 3,335,904 | 8/1967 | Anderson | 220/71 |
| 3,677,432 | 7/1972 | Kaempen | 220/71 |
| 3,680,727 | 8/1972 | Pearson | 220/71 |
| 3,700,512 | 10/1972 | Pearson et al. | 220/5 A |
| 3,895,152 | 7/1975 | Carlson et al. | 220/901 |
| 3,990,600 | 11/1976 | Rossitto et al. | 220/71 |
| 4,004,706 | 1/1977 | Guldenfels et al. | 220/68 |
| 4,098,425 | 7/1978 | Yamamoto | 220/901 |
| 4,181,237 | 1/1980 | Kenyon et al. | 220/5 A |
| 4,327,554 | 5/1982 | Patil et al. | 220/901 |
| 4,394,930 | 7/1983 | Korpman | 220/444 |
| 4,768,678 | 9/1988 | Nusbaumer et al. | 220/444 |
| 4,821,915 | 4/1989 | Mayer | 220/5 A |
| 4,825,687 | 5/1989 | Sharp | 200/444 |

FOREIGN PATENT DOCUMENTS

| | | | |
|---|---|---|---|
| 2940101 | 4/1980 | Fed. Rep. of Germany | 220/71 |

*Primary Examiner*—Stephen Marcus
*Assistant Examiner*—Stephen Castellano
*Attorney, Agent, or Firm*—Oblon, Spivak, McClelland, Maier & Neustadt

[57] ABSTRACT

A steel rib, designed for affixation to the interior of an underground storage tank, provides improved compression characteristics, with a reduction in cost of preparation and materials. The rib is provided with diametrically opposed vents, which may be formed by cutting a portion of a hollow, rectangular rib, rotating it 90° in a direction orthogonal to the plane of the rib, and reaffixing it, so as to occlude the interior of the rib. When used to reinforce a double-walled tank, the rib allows the strengthening of the outer wall to enhance resistance to penetration and damage frequently incurred in handling, and reduce installation costs.

5 Claims, 2 Drawing Sheets

UNDERGROUND STORAGE TANK OF CORROSION-RESISTANT MATERIALS WITH INTERNAL STEEL RIB

BACKGROUND OF THE INVENTION

1. Field of the Invention

This invention pertains to underground storage tanks, such as those conventionally employed for the storage and dispensing of gasoline at automobile service stations. More specifically, it pertains to an underground storage tank made of corrosion-resistant materials provided with an internal steel rib.

2. Background of the Prior Art

A wide variety of liquid materials, notably among them petroleum distillate products, are kept in underground storage tanks, for controlled release or dispensing, generally through aboveground dispensing means, such as service station pumps and the like. Conventionally, such tanks are cylindrical in shape, with dome or egg-shaped end caps at either end of the cylinder. Such tanks are buried in the ground, with access to a fill pipe, and a pump for removing liquid from the storage tank.

Recently, considerable attention has been focused on such storage tanks, as potential sources of environmental pollution. In particular, concern has been raised that leakage from, or failure of, the tank, can result in the undetected release of a large quantity of hazardous product in densely populated areas. As one example of potential problems, the use of steel tanks is presented with the possibility of corrosion of the steel, particularly if the underground installation site should become filled with water, or brine. Thus, as set forth in U.S. Pat. Nos. 3,335,904 and 3,700,512, there has been increasing stress placed on the use of corrosion-resistant materials, such as resin reinforced with filamentary materials, generally fiberglass, in substitution of steel. While such materials may be generally designed stronger than steel, nonetheless, there remains in the marketplace a great desire for steel tanks, where possible, perhaps because of the common familiarity with the strength of such products. Additionally, steel alloys, on a volume basis, present a stiffer material than conventional reinforced resins, and accordingly may offer superior compression resistance, inch-for-inch of material. Compression of a tank in a "wet hole" represents the "worst possible scenario", in terms of design tolerances. To this end, many steel tanks are treated with corrosion-preventive coatings, yet this remains a partial solution, at best.

Even the use of fiberglass reinforced resin materials, etc., however, is not a perfect solution. In particular, the problem of leakage presented by damage to, or puncture of, the tank, remains. To this end, a variety of double-walled tanks, made of corrosion-resistant materials, have been advanced. Representative of such designs is that described in U.S. Pat. No. 4,561,292. Such tanks actually are comprised of two concentric tanks, with an annular space therebetween. The outer tank serves as a containment means for any leakage from the inner tank, and the space between the two tanks can be provided with a monitoring means, to detect the presence of fluid of a particular type. Thus, leakage in either the outer tank or the inner tank may be detected, and addressed. Such tanks are complicated by the general and common structure of fiberglass reinforced resin tanks and the like, which employ molded-in external ribs to enhance strength, and resistance to deflection. The ribs consume a large quantity of time and material.

The formation or a rib is a particularly complicated matter, whether prepared by a male molding process, as set forth at Column 2 of U.S. Pat. No. 4,561,292, or female molded, such as that disclosed in U.S. Pat. No. 4,363,687. Further, when prepared according to the former process, the ribs are not integral with the tank cylinder but attached thereto. Under the compression forces applied in a wet hole, such ribs may be "blown off", or separated from the tank leading to potential catastrophic failure.

Accordingly, it remains an object of the art to provide an underground storage tank which is contained against leakage, comprised of corrosion-resistant materials, yet retains the features and commercial attractiveness and stiffness of steel materials.

SUMMARY OF THE INVENTION

This invention comprises an underground storage tank, preferably double-walled, which is provided with an internal rib, comprised of hollow steel or aluminum or similar alloy. The internal rib may be formed from a hollow rectangular tubing, a small portion at what will become the top of the rib being cut, and rotated in a plane orthogonal to the rib 90 degrees, so as to interrupt the interior of the rib, and to provide a vent along the top of the rib, through which fluid, such as a gas, in the interior of the tank, can pass. A similar vent is provided in the bottom of the tank. Alternative shapes are provided. By providing strength against compression from within, the interior wall of a double-walled tank may be reduced in thickness, substantially, down to a minimal lining coat. This allows enhanced thickness on the outer wall, which is subject to breakage and penetration during handling and transportation. The improved tank combines the qualities and attractiveness of steel, and the corrosion resistance of fiberglass-reinforced resins.

DETAILED DESCRIPTION OF THE INVENTION

Figure 1:
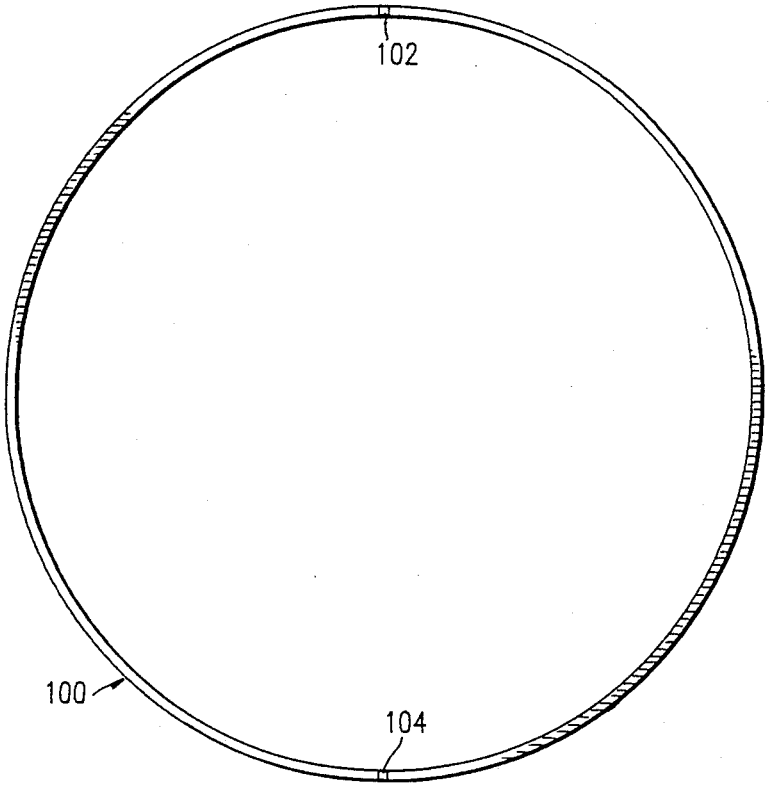
FIG. 1 is an illustration of the steel rib of the invention, with pass-throughs provided at opposed points along the diameter of the rib.
Figure 2:
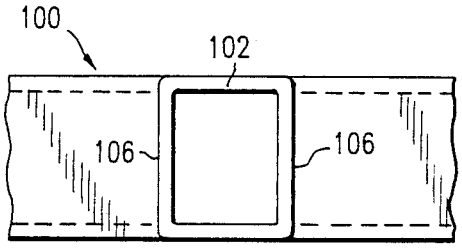
FIG. 2 is an expanded view of the vents provided in the rib.

The storage tank of this invention may be supported, in whole, or in part, by the internal rib. In a preferred embodiment, only internal ribs are provided, the external ribs of the prior art being avoided entirely. As illustrated in FIG. 1, the rib may be entirely circular. It is preferred that the rib be comprised of hollow tubing, and, as an example, rectangular tubing of dimensions 1 by 1.25 by 0.10 inches can be employed. These dimensions are not limiting, and other dimensions, of similar relation, may be employed. At opposed points 102 and 104, which will become the top and bottom of the rib when installed, a small portion of the rib is cut, and rotated 90°, such that the interior of the cut portion is sealed off from the remainder of the tubing, and the longitudinal axis thereof is orthogonal with regard to a diameter of the tubing drawn at that point. Thus, the interior of the tubing is now occuluded by walls 106, which are welded, at their perimeter, to the remainder of the tube.

The vent is essential to allow vapor, trapped in the tank, to pass along the top of the tank, to a vent pipe, and so escape to the outside, or some controlled recovery device. In installation, the tank will be installed at a slight angle, to induce the gas to pass to the vent, which is placed at the uppermost end. In the absence of the vents provided, gas bubbles would form at the top of the tank, and lodge there, against the rib, preventing complete filling, and perhaps threatening the integrity of the tank.

As noted above such vents are provided at both the upper and lower end of the rib, as installed. The lower vent is essential to provide for the passage and drainage of liquid, such as the stored product, to the end of the tank opposed to the vent, so that 100 percent of the liquid may be drained, when it becomes necessary to change the nature of the product in the tank, or access the interior of the tank, e.g., for repairs. In the absence of an appropriate passthrough device, such as the vent described, pools of liquid would be formed behind the rib.

Alternative, desirable rib configurations can also be employed. Thus, I-Beams, T-Beams, J-Beams, and related shapes can be employed. Additionally, hollow or solid beams of shapes in addition to rectangular, such triangular, circular, hexagonal, etc., can be prepared. The hollow rectangular shape is desirable from the point of view that it facilitates the provision of ports or vents 102. If other shapes, or solid forms, are used, these ribs must either be cast with ports 102 pre-formed, or such ports must be subsequently formed by drilling, etc.

The internal rib may be advantageously used in either a single-wall or double-walled tank. Installation is straightforward, involving the completion, first, of a tank half, according to well-established prior art processes. The tank may be prepared through either male molding, as described in U.S. Pat. No. 4,561,292, removed from mandrel, and the rib inserted, the rib may be placed on the mandrel prior to tank formation, or the tank may be prepared through female molding, as set forth in U.S. Pat. No. 4,363,687. In either event, it should be noted that the mold or mandrel, and resultant cylinder, will have an essentially smooth outer topography, that is, be devoid of ribs. This substantially reduces the time and materials needed to prepare the tank. If female molded, the storage tank body is first prepared, and the rib is installed in the interior thereof. Male molding is preferred, so as to allow prior fixing of the ribs in place, on the mandrel. As the rib is circular in shape, of an external radius essentially equal to that of the internal radius of the tank, the rib may be "walked" in, prior to application of a final coat of resin mixture to the interior of the tank. Alternatively, the rib may be prepared in two or more sections, and assembled, in the interior of the tank. The rib is easily affixed to the interior of the tank, and prevented from possible corrosion due to the materials contained within the tank, by applying a complete layer of fiber reinforced resin across the rib, sealing it to the interior of the tank. This locks the rib into place, and provides corrosion protection. In another alternative, the rib may be overlayed with a layer of fiberglass matting or fabric, and the fabric adhered to the adjacent portions of the interior of the tank, and coated with, resinous material.

Figure 3:
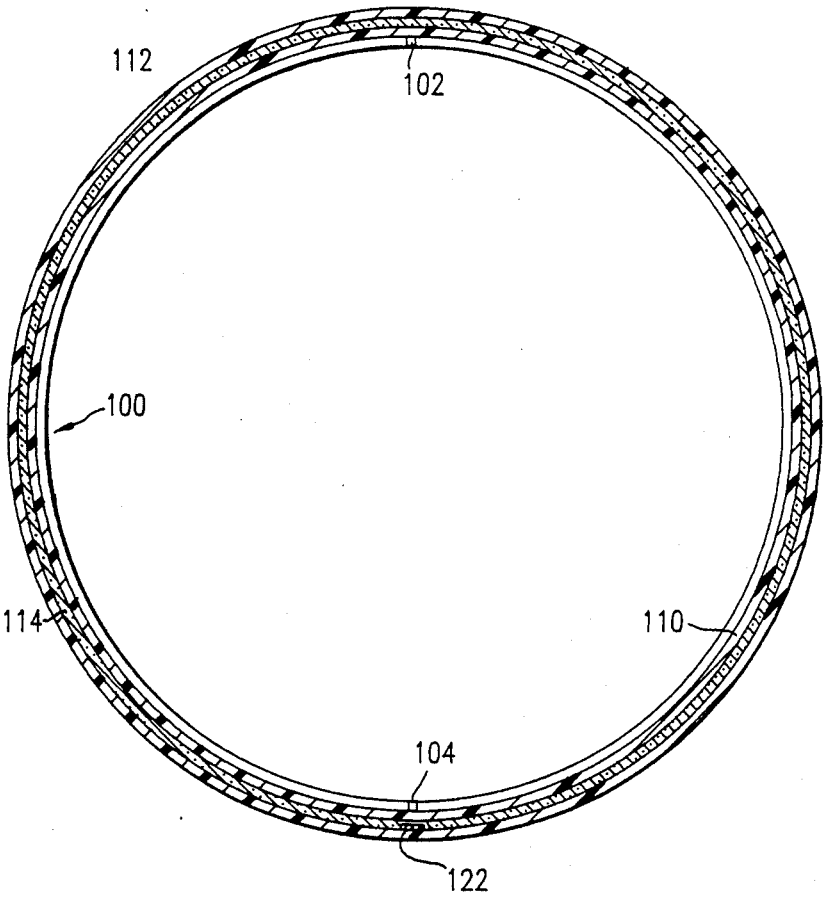
FIG. 3 is a cross-sectional view of a rib installed in an underground storage tank.

As noted, the rib of the invention, and the tank provided therewith, can be advantageously used with either or single or double-walled tanks. However, specific and important advantages are secured when used in conjunction with a double-walled tank. Specifically, the use of an extremely stiff internal rib to lend strength and particularly compression resistance to the tank allows the preparation of a double walled tank with a very thin, and relatively weak, internal tank or shell. This should be contrasted with prior art tanks, such as that described in U.S. Pat. No. 4,561,292. Such tanks generally are comprised of two completely independent structural shells, which are joined, and spaced from each other, by the ribs of the internal tank. This design requires two independent shells. In the claimed invention, since compression resistance is provided from the interior, the internal shell may be reduced to a corrosion and diffusion-resistant liner, such as that prepared from a vinyl ester resin, reinforced or otherwise, of about ¼ inch thickness. As illustrated in FIG. 3, this internal shell 110 is that which rib 100 is adhered to. The respective layers of the tank in FIG. 3 have been enlarged out of scale, in order to show detail.

In conventional double-walled tanks, the inner shell is spaced from the outer shell 112 by external ribs. As no external rib is necessary using the rib of this invention the outer shell may be simply spaced from the inner shell by a lightweight, preferably porous material 114. One particular advantage conferred by the invention of this application is the fact the outer shell 112 can be reinforced with extra fiber-reinforced resinous material, to provide additional thickness, and resistance to penetration, as compared with prior art tanks, with no addition of material, weight, or significant cost. Thus, a double-walled tank can be provided with an exterior shell of sufficient strength and thickness such that it may be directly unloaded from a truck, without the use of a crane, thereby significantly reducing installation costs, without jeopardizing the integrity of the tank. The thicker outer shell also reduces the level of care that need be exercised in installation, which is frequently a problem due to the generally low level of experience shared by many of those responsible for installation. In a conventional tank, the outer shell of fiber reinforced resinous material may be ¼ inch in thickness. The outer shell of the claimed invention may be ⅜ inch or more, without the addition of material, weight or cost, in view of the reduced thickness of the interior shell.

Figure 4:
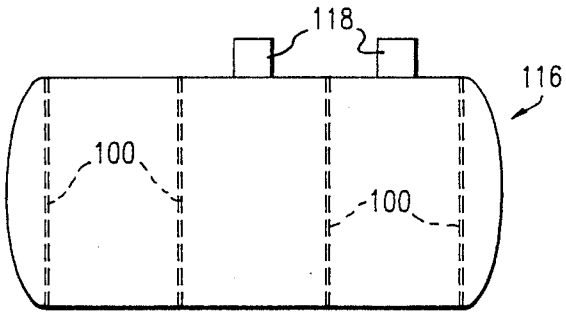
FIG. 4 is an illustration of a prototypical storage tank with internal ribs according to the invention.

As illustrated in FIG. 4, the resulting cylindrical tank, with end caps, presents a smooth outer surface, devoid of exterior ribs; interior ribs 100 depicted in phantom outline, are entirely contained within the interior of the tank. Tank 116 is provided with fittings 118, which determine the top of the tank, where at least one vent 102 will lie in each rib. The fittings are entirely conventional, and do not constitute an aspect of this invention. Tank 116 may be either single-walled or double-walled. When double-walled, it is conventional to place an alarm means in the space between the inner and outer shell. The invention of this application can accommodate such alarm means, which would include a "wet alarm", i.e., a liquid filling the annular space, which space is in communication with a riser, the liquid being filled to a level in the riser above the tank. Should a leak occur in either the inner or outer shell, the level is expected to fall, setting off alarms. Alternatively, a dry monitor 122 may be inserted in the bottom of tank 116, in the space between inner shell 110 and outer shell 112, sensitive to the presence of petroleum products, or other liquids to be stored. While either system can be used with this invention, a particularly preferred embodiment employs as material in the annular space a load-transmitting material, which will pass liquids, due to its porous nature, in the space between inner shell 110 and outer shell 112. This further strengthens the tank, while permitting the use of either a "wet" or "dry" alarm system. Such a tank, using external ribs, is disclosed in co-pending patent application U.S. Ser. No. 317,565, filed Mar. 1, 1989, in the name of Robin Berg et al, the entire disclosure of which is incorporated herein by reference.

Obviously, numerous modifications and variations of the present invention are possible in light of the above teachings. As an example, the rib of the invention might be cast as a single unit, avoiding the need to cut and weld. This does not depart from the scope of the invention. It is therefore to be understood that within the scope of the appended claims, the invention may be practiced otherwise than as specifically described herein.

What is claimed as new and desired to be secured by Letters Patent of the United States is:

1. A storage tank designed for installation underground, said tank comprising a first shell of resinous material defining an interior and having an internal diameter, said shell having affixed, to its interior, a plurality of reinforcement ribs, each said rib comprising a ring comprised of a steel alloy having an external diameter and a longitudinal thickness, the external diameter of said ring being substantially equal to the internal diameter of said tank, said rib bearing, at two points intersected by a single diameter of the rib, openings formed through the longitudinal of said rib, said openings being in fluid communication with said shell interior.

2. The storage tank of claim 1, wherein said tank further comprises a second shell enclosing said first shell, said second shell being comprised of resinous material and forming an annular space between said first and second shells.

3. The double-walled tank of claim 2, wherein said first and second shells are spaced from each other by a porous material therebetween.

4. The double-walled tank of claim 3, wherein said the space between said first and second shell is provided with a leakage alarm means.

5. The double-walled tank of claim 3, wherein said porous material transmits load applied to either said first or second shell from the direction opposite to said annular space, across said annular space to said remaining shell.

* * * * *